US009604232B2

(12) United States Patent
Baumann et al.

(10) Patent No.: US 9,604,232 B2
(45) Date of Patent: Mar. 28, 2017

(54) AXIAL TURBINE FOR A ROTARY ATOMIZER

(75) Inventors: Michael Baumann, Flein (DE); Frank Herre, Oberriexingen (DE); Marcus Frey, Weil der Stadt (DE); Bernhard Seiz, Lauffen (DE); Harry Krumma, Bönnigheim (DE); Timo Beyl, Besigheim (DE); Jürg Schiffmann, Bern (CH); Stephan Scholl, Herzogenbuchsee (CH)

(73) Assignee: Duerr Systems GmbH, Bietigheim-Bissingen (DE)

( * ) Notice: Subject to any disclaimer, the term of this patent is extended or adjusted under 35 U.S.C. 154(b) by 1217 days.

(21) Appl. No.: 13/638,193

(22) PCT Filed: Mar. 2, 2011

(86) PCT No.: PCT/EP2011/001038
§ 371 (c)(1),
(2), (4) Date: Sep. 28, 2012

(87) PCT Pub. No.: WO2011/120619
PCT Pub. Date: Oct. 6, 2011

(65) Prior Publication Data

US 2013/0017068 A1 Jan. 17, 2013

(30) Foreign Application Priority Data

Mar. 31, 2010 (DE) ..... 10 2010 013 551

(51) Int. Cl.
*F01D 1/02* (2006.01)
*B05B 3/10* (2006.01)
*B05B 5/04* (2006.01)

(52) U.S. Cl.
CPC ..... *B05B 3/1035* (2013.01); *B05B 5/0415* (2013.01); *B05B 3/1042* (2013.01); *B05B 3/1092* (2013.01)

(58) Field of Classification Search
CPC ... B05B 3/1035; B05B 3/1042; B05B 3/1092; B05B 5/0415; F01D 1/02; F01D 1/06; F01D 25/16; F01D 5/02
See application file for complete search history.

(56) References Cited

U.S. PATENT DOCUMENTS 4,361,287 A * 11/1982 Morishita ..... B05B 5/0415 239/223
6,056,215 A 5/2000 Hansinger et al.
(Continued)

FOREIGN PATENT DOCUMENTS

DE 459519 C 5/1928
DE 560836 C 10/1932
(Continued)

OTHER PUBLICATIONS

Notification of Reason for Rejection from the Japan Patent Office for Japanese Patent Application No. 2013-501659, dated Sep. 24, 2015 (English Translation; 9 pages).
(Continued)

*Primary Examiner* — Gregory Anderson
*Assistant Examiner* — Maxime Adjagbe
(74) *Attorney, Agent, or Firm* — Bejin Bieneman PLC

(57) ABSTRACT

A turbine rotor, e.g., for a drive turbine of a rotary atomizer, is disclosed having a rotatably supported turbine shaft with the potential for mounting an atomizer wheel, and having at least one drive turbine wheel having a plurality of turbine blades. The turbine blades of the drive turbine wheel may be impinged on during operation by a drive fluid in order to drive the turbine rotor. The drive turbine wheel may be
(Continued)

designed for the drive fluid to axially impinge on the turbine blades. A complete drive turbine having such a turbine rotor is also disclosed, as well as a complete rotary atomizer and individual exemplary components of the drive turbine.

34 Claims, 13 Drawing Sheets

(56) References Cited

U.S. PATENT DOCUMENTS 7,131,601 B2 * 11/2006 Nolte ..... B05B 5/0415 239/222.11
7,322,793 B2 1/2008 Baumann et al.

FOREIGN PATENT DOCUMENTS

| | | | |
|---|---|---|---|
| DE | 38045 | A1 | 5/1965 |
| DE | 1954130 | B2 | 8/1972 |
| DE | 3317695 | A1 | 11/1984 |
| DE | 19816648 | A1 | 11/1998 |
| DE | 10233199 | A1 | 2/2004 |
| DE | 102009034645 | | 1/2011 |
| EP | 0037645 | B2 | 2/1988 |
| EP | 0837223 | A2 | 4/1998 |
| JP | S56141864 | A | 11/1981 |
| JP | S57169455 | U | 10/1982 |
| JP | S58-124254 | U | 8/1983 |
| JP | S60-189351 | U | 12/1985 |
| JP | H10-212901 | A | 8/1998 |
| JP | H10-305241 | A | 11/1998 |
| JP | 2004321844 | A | 11/2004 |
| JP | 2008-104903 | A | 5/2008 |

OTHER PUBLICATIONS

International Search Report, PCT/EP2011/001038, Dated Jun. 17, 2011.

* cited by examiner

AXIAL TURBINE FOR A ROTARY ATOMIZER

CROSS-REFERENCES TO RELATED APPLICATIONS

This application is a National Stage application which claims the benefit of International Application No. PCT/EP2011/001038 filed Mar. 2, 2011, which claims priority based on German Application No. DE 10 2010 013 551.8, filed Mar. 31, 2010, both of which are hereby incorporated by reference in their entireties.

BACKGROUND

The present disclosure is directed to a turbine rotor, e.g., for driving a rotary atomizer turbine, a drive turbine with a turbine rotor, and further components of a rotary atomizer such as a bearing unit, an intermediate sleeve, a deflection ring and a stator ring.

In modern painting installations for painting motor vehicle body components, a rotary atomizer is usually used as an application device, which has a bell cup as an application element. The drive for conventional rotary atomizers may be pneumatic using a drive turbine which is blown through with compressed air, wherein the drive turbine is formed as a radial turbine. This means that the compressed air acting as a drive fluid flows on the turbine blades of the drive turbine in a plane which is radial to the rotational axis of the bell cup. Use of a radial turbine for driving a rotary atomizer offers the advantage that the required drive torque can be reached in such a way that a drive turbine wheel with an appropriately large diameter is used.

The disadvantage of using a radial turbine for driving a rotary atomizer is, however, that the limited driving power can hardly be made to exceed 650 W for adequately fine atomization in an rpm range of 8,000-80,000 rpm, whereby the paint outflow rate is limited to values of approximately 1,000 ml/min. This basic disadvantage of a radial turbine also cannot be removed by increasing the size of the radial turbine since this is not possible due to space and weight considerations. Also achieving an increase in the maximum possible driving power by increasing the pressure level or the air throughput of the drive air is practically not possible since this would lead to excessively high investment or operating costs.

Accordingly, there is a need for a rotary atomizer having an increased maximum possible driving power.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
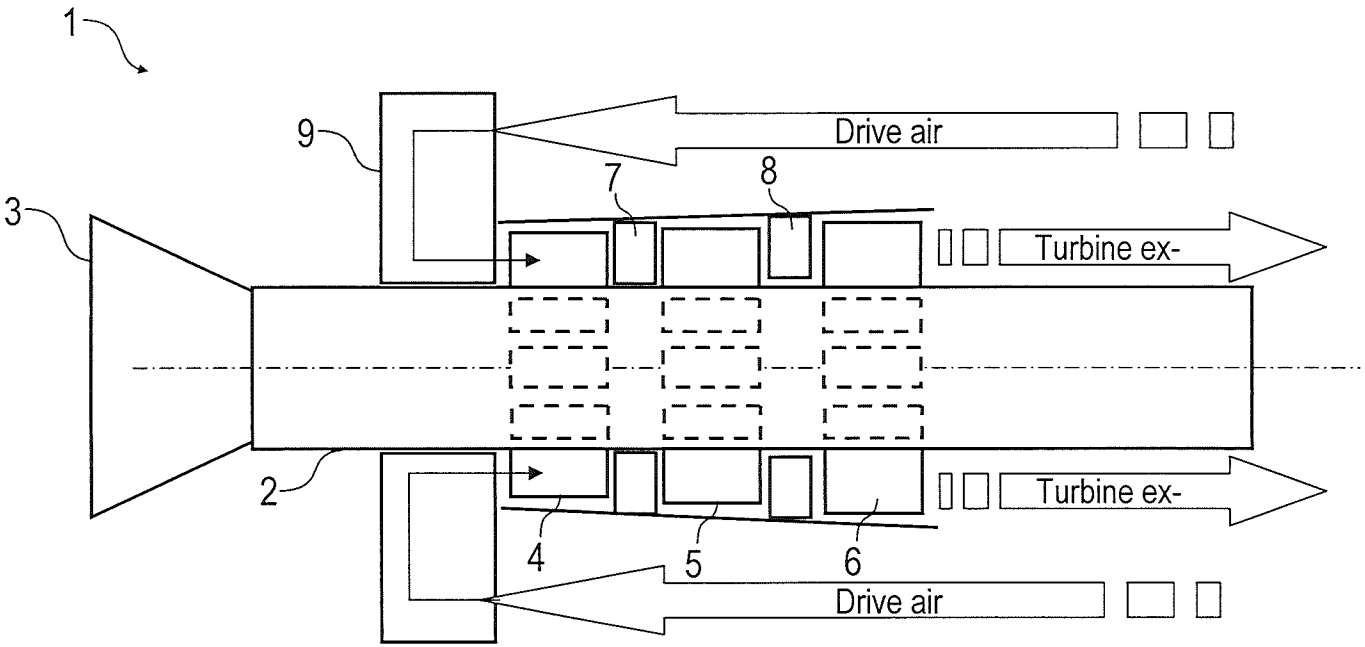
FIG. 1 a schematic representation of an axial turbine for driving a rotary atomizer, according to an exemplary illustration, FIG. 2 a schematic perspective representation for elucidation of assembly of a plurality of rotor rings for the exemplary axial turbine on the turbine shaft, FIG. 3 an exploded view of an exemplary illustration of an axial turbine for driving a rotary atomizer, FIG. 4 a sectional view of the front region of the exemplary drive turbine according to FIG. 3, FIG. 5 a cut away perspective view of a turbine housing of the exemplary drive turbine from FIGS. 3 and 4, FIG. 6 a cut away perspective view of the intermediate sleeve of the exemplary drive turbine according to FIGS. 4 and 5, wherein there is already a radial bearing and a deflection ring mounted in the intermediate sleeve, FIG. 7 a cut away perspective view of the exemplary drive turbine itself, wherein the drive turbine includes a plurality of stator rings and a plurality of rotor rings, FIG. 8 a cut away perspective view of an exemplary radial axial bearing of the exemplary drive turbine from FIGS. 3 to 7, FIG. 9 a cut away perspective view of the exemplary turbine shaft of the exemplary drive turbine with a brake from FIGS. 3 to 8, FIG. 10 a schematic illustration of the blade geometry of the exemplary turbine blades, FIG. 11 a side view of a rotary atomizer, according to an exemplary illustration, with the drive turbine from FIGS. 3 to 9, FIG. 12A a frontal view of the bearing flange of the drive turbine with numerous connections.

Various exemplary illustrations are disclosed herein of a turbine rotor, components of and systems using the same, and methods of using the same. For example, exemplary illustrations comprise a complete drive turbine with such a turbine rotor. Furthermore, the exemplary illustrations also comprise further components of a rotary atomizer, such as an intermediate sleeve, a bearing unit, a drive turbine wheel, a deflection ring and a stator ring.

The exemplary illustrations described herein encompass the general technical teaching to use an axial turbine to drive a rotary atomizer for which the drive fluid (for example compressed air) axially flows over the turbine blades of the drive turbine wheel axial, that is to say parallel to the rotary axis of the bell cup.

The exemplary illustrations therefore comprise a turbine rotor with a rotatably mounted turbine shaft with an assembly option to attach a bell cup. One option for mounting the bell cup on the turbine shaft is that the bell cup is screwed onto the turbine shaft, which is also serving as the bell cup shaft. Another option for mounting the bell cup on the turbine shaft which is also serving as the bell cup shaft is that the bell cup is fastened to the turbine shaft by a clamping or latching connection as described, for example, in DE 10 2009 034 645, so that the contents of this patent application should be added in full to the above description concerning mounting of the bell cup on the turbine shaft. The exemplary illustrations are, however, not limited to the above-mentioned examples concerning mounting of the bell cup on the turbine shaft but rather fundamentally allows other systems for mounting.

Furthermore, an exemplary turbine rotor may have at least one drive turbine wheel with a plurality of turbine blades, wherein the turbine blades on the drive turbine wheel have a drive fluid flowing over them (for example compressed air) during operation in order to drive the turbine rotor. The drive turbine wheel may be connected in a twist-proof manner with the turbine shaft in order to be able to transmit the torque from the drive turbine wheel to the turbine shaft. One option to do this, merely as an example, is to manufacture the turbine shaft and the drive turbine wheel in one piece as a single component. It is also possible within the scope of the exemplary illustrations, as an alternative, that the drive turbine wheel and the turbine shaft are separate components, which are simply connected in a twist-proof manner with each other.

The exemplary illustrations therefore may provide a drive turbine wheel designed for axial flow of drive fluid over the turbine blades. In contrast to this the drive turbine wheels on conventional radial turbines are designed for radial flow of drive fluid over the turbine blades.

This departure from the conventional principle of a radial turbine through to the principle according to the exemplary illustrations of an axial turbine advantageously allows an increase in the maximum possible driving power since the axial turbine according to the exemplary illustrations can have more drive turbine wheels arranged one behind the other (stages).

In one example, the turbine rotor is fitted with a number (for example 2, 3, 4 or 5) of drive turbine wheels arranged axially one behind the other, wherein the individual drive turbine wheels each have a plurality of turbine blades which are designed for axial flow of drive fluid (for example compressed air) over the turbine blades.

In the above exemplary illustration the drive turbine wheels extend in an axial direction together over a certain drive length and are arranged in a turbine housing with a certain outer diameter, wherein the ratio of the outer diameter of the turbine housing on the one hand and the drive length on the other hand may be, e.g., greater than 0.4-0.6 and/or less than 0.78-1. However, with regard to the dimensioning of the turbine housing, the exemplary illustrations are not restricted to the above-mentioned example values but can fundamentally be also realized with other dimensions.

Furthermore, it should be mentioned that the drive turbine wheels may be surrounded by stator rings with a certain maximum outer diameter, wherein the ratio of the outer diameter of the stator rings on the one hand and the drive length on the other hand is in the range of 0.4-0.5, merely as an example. With regard to the dimensioning of the stator rings, the exemplary illustrations are not restricted to the above-mentioned example values but can fundamentally be also realized with other dimensions.

For the turbine rotor according to the exemplary illustrations, the individual turbine blades on the drive turbine wheel may have a certain blade height in the radial direction, wherein the blade height, in this connection, is measured between the radial inner blade edge on the one hand and the radial outer blade edge. Here the blade height may lie in the range 0.5-50 mm, but the exemplary illustrations can fundamentally be also realized with other values for the blade height.

For the above-mentioned exemplary illustration with a plurality of drive turbine wheels axially arranged one behind the other, the individual drive turbine wheels can have a different blade height wherein the blade height in the direction of flow and/or opposite to the spraying direction of the rotary atomizer can increase.

It should, furthermore, also be mentioned that the turbine blades of the drive turbine wheel in the above exemplary illustrations may be designed in such a way that the drive fluid (for example compressed air) flows over the turbine blades opposite to the direction of spraying of the rotary atomizer. The drive fluid is therefore initially led here from the robot side of the drive turbine to the bell cup side of the drive turbine and is then deflected through 180° so that the drive fluid is flowing opposite to the direction of spraying through the axial turbine.

It is, however, also fundamentally possible, within the scope of the exemplary illustrations, that the drive fluid flows through the axial turbine in the direction of spraying of the rotary atomizer, wherein no deflection of the drive fluid is then necessary.

The blade height already defined above for the individual turbine blades of the drive turbine wheel may, in one example, lie in a particular ratio to the diameter of the turbine shaft, wherein a ratio of 0.01-2.5 or 0.015-0.5 has been proven to be advantageous in one example. However, the exemplary illustrations are not restricted, with regard to the dimensioning of blade height, to the above-mentioned example value ranges but can fundamentally also be realized with other values for the blade height.

Furthermore, the individual turbine blades on the above exemplary illustrations may have a constant basic diameter of the blade, wherein this is the distance between the blade edges and the rotary axis. As an alternative, however, it is also possible that the basic diameter of the blade on the neighboring drive turbine wheels is different. For example, the basic diameters of the blade can decrease from one drive wheel to the next drive wheel in the direction of flow so that the through-flow cross-section in the direction of flow increases, which is desirable from a fluid dynamics point of view.

Furthermore, in the exemplary illustrations, there may be a certain blade density of the drive turbine wheels provided, wherein the blade density can, for example, be in the range of 20-60 turbine blades per drive turbine wheel, merely as an example. The blade density of the individual drive turbine wheels can differ in this configuration, wherein the blade density of the drive turbine wheels can increase from one drive turbine wheel to the next drive turbine wheel in the direction of flow. As an alternative, however, it is also possible that the blade density of the drive turbine wheels increases from one drive turbine wheel to the next drive turbine wheel opposite to the direction of flow. It is, furthermore, also possible that the different drive turbine wheels of the axial turbine have the same blade density.

In the exemplary illustrations the drive turbine wheel may be formed as a single part or multiple-part ring which is releasably arranged on the turbine shaft. For example, the drive turbine wheel formed as a ring can be clamped to the turbine shaft, in particular by means of a press fit or through thermal shrink fitting.

Furthermore, it should be mentioned that the turbine blades of the drive turbine wheel can be manufactured by means of a generative manufacturing process, wherein these types of generative manufacturing process are also known under the keyword "Rapid Prototyping".

Furthermore, the axial turbine according to the exemplary illustrations may also have a brake turbine wheel in order to brake the rotary atomizer as quickly as possible. To this effect, the brake turbine wheel according to the exemplary illustrations has a plurality of turbine blades which can have a brake fluid (for example compressed air) flowing over them, during operation, in order to brake the turbine rotor.

The individual turbine blades of the brake turbine wheel may be designed for radial flow of brake fluid (for example compressed air) over the turbine blades such as is the case for conventional brake turbine wheels. For example, the brake turbine wheel can therefore be formed as a Pelton turbine wheel.

The brake turbine wheel can, in this case, be arranged in an axial direction between two bearing points on the turbine shaft. As an alternative, however, it is also possible that the brake turbine wheel is arranged in an axial direction outside both bearing points on the turbine shaft.

It should also be mentioned that the brake turbine wheel may have a significantly larger diameter than the drive turbine wheel. This is desirable so that an adequately large brake torque can be generated.

Concerning the blade profile of the individual turbine blades of the drive turbine wheel or the brake turbine wheel, there are many options within the scope of the exemplary illustrations. For example, the turbine blades can have a symmetrical or semi-symmetrical profile, a reflexed trailing edge or a taper profile just to mention a few examples.

In one exemplary illustration, the turbine blades may, however, have a certain geometry. More specifically, individual turbine blades may have an inlet angle in the region of 65-75°, whereas in the prior art an inlet angle of about 60° is usual. The outlet angle of the turbine blades, on the other hand, may equal the inlet angle with a tolerance range of ±10° or even ±5°. The outlet angle of the turbine blades, on the other hand, may lie in the range 55°-75°. This, in the exemplary illustrations, means that the sum of the inlet angle and the outlet angle may lie in the range of 110°-145°.

Furthermore, it should be mentioned that the turbine rotor according to the exemplary illustrations may have a certain specific rotational speed $n_S$, which can be calculated using the following formula:

$$n_S = \frac{\omega \cdot V^{0.5}}{e^{0.75}}$$

with:

V: volumetric flow rate at the entrance [$m^3/s$]

e: specific work [J/kg]

ω: rotational speed [rad/s].

The specific rotational speed $n_S$ may, in one exemplary illustration, lie in the range of 0.1-0.3, whereas the specific rotational speed of conventional axial turbines is usually in the range of 0.5-1.

For the turbine rotor according to the exemplary illustrations the turbine shaft has a plurality of bearing points to rotatably mount the turbine shaft on bearings, wherein the bearing points can, for example, be particularly hardened. The drive turbine wheel may be arranged here in an axial direction between both bearing points. This may advantageously allow a large axial distance between the bearing points, which in turn leads advantageously to a strongly increased tilting rigidity. This allows significantly higher robot acceleration values for handling of the rotary atomizer by a painting robot and therefore also higher painting speeds for non-linear painting paths.

The bearing points on the turbine shaft here have a certain bearing length in an axial direction, while the turbine shaft has a certain shaft diameter. For the turbine rotor according to the exemplary illustrations, the bearing length may lie in a particular ratio to the shaft diameter, wherein this ratio may lie, in one example, in the range of 0.8-1.2, wherein a value of 1 has proven itself to be particularly advantageous. The exemplary illustrations can, however, also be fundamentally realized using other values.

It should also be mentioned that, in one exemplary illustration, the turbine shaft is hollow. The shaft internal diameter of the hollow turbine shaft may, however, be so large that the turbine shaft can receive a paint tube with at least two main needles and at least two returns, whereas conventional rotary atomizers mostly only have one main needle and a single main needle valve. In contrast to the above, the rotary atomizer according to the exemplary illustrations with at least two main needle valves does allow very low paint change times and losses, since it is possible to paint over the one main needle valve while the next paint to be used is already being delivered to the second main needle valve. For a change of paint it is then just necessary to flush out the line area, which lies downstream behind the previously used main needle valve. One could also conceive of a paint tube with a smaller diameter for simple use, that is to say the existing space is not used.

It is furthermore also possible that the shaft internal diameter of the hollow turbine shaft is so large that the hollow turbine shaft can receive two mixing elements for two-component material (for example basic varnish and hardener).

The shaft internal diameter of the turbine shaft therefore may lie, in one exemplary illustration, in the range of 20-40 mm.

Furthermore, it should be mentioned that the turbine shaft may be shorter in an axial direction than 15 centimeters (cm), 14 cm or 13 cm, wherein the bearing points may have an axial distance between them of more than 3 cm, 6 cm or 10 cm.

Therefore, the exemplary illustrations not only encompass the previously described exemplary turbine rotors as an individual component, but also a complete drive turbine for a rotary atomizer fitted with such a turbine rotor. Furthermore, for the exemplary illustrations also encompass a rotary atomizer with an exemplary axial turbine and for a painting robot with a rotary atomizer which, contrary to the prior art, contains an axial turbine.

The exemplary drive turbine may be characterized by a certain specific mechanical driving power, wherein the specific driving power is 0.6 Wmin/Nl, 0.7 Wmin/Nl, 0.8 Wmin/Nl or even 0.9 Wmin/Nl, merely as examples. The specific mechanical driving power in this sense is the ratio between the mechanical driving power of the drive turbine on the one hand and the volume flow of the fed in drive fluid (for example compressed air) on the other hand.

Furthermore, the exemplary drive turbines can be characterized by a specific mechanical driving power which lies in the range of 0.7 W/g-1.5 W/g, merely as an example. The specific mechanical driving power in this sense is the ratio between the mechanical driving power of the drive turbine on the one hand and the mass of the drive turbine on the other hand.

Furthermore, the specific mechanical driving power may, in one exemplary illustration, lie in the range of 1.5 $W/cm^3$-10 $W/cm^3$, wherein the specific mechanical driving power in this sense is the ratio between the mechanical driving power of the drive turbine on the one hand and the construction space needed for the drive turbine on the other hand. Therefore, the use of an exemplary axial turbine may advantageously allow a greater power density than that achievable with conventional radial turbines.

In one exemplary illustration, an axial turbine may be employed to drive a rotary atomizer with a driving power of more than 1000 W or even more than 1400 W.

Furthermore, a thermal efficiency of more than 50%, 60% or even more than 70% can be realized, in particular for a rotational speed of between 40,000 rpm and 60,000 rpm, and for a volume flow of the drive fluid (for example compressed air) of between 800 Nl/min and 1,200 Nl/min.

Moreover, it should be mentioned that the specific mechanical driving power can be greater than 0.1 W/mbar, 0.2 W/mbar, 0.3 W/mbar or even greater than 0.4 W/mbar, wherein the specific mechanical driving power in this sense is the ratio between the mechanical driving power on the one hand and the pressure difference between the inlet and the outlet on the other hand.

It was already mentioned above that the drive fluid (for example compressed air) flows through the axial turbine, e.g., in a direction opposite to the direction of spraying, wherein the drive fluid is, however, fed in from the robot side. This guiding of the drive fluid makes deflection of the drive fluid necessary, wherefore there may be a deflection ring provided. In one exemplary illustration, the deflection of the drive is, however, only partially in the deflection ring. Thus, the drive fluid may enter the deflection ring at right angles to the rotational axis of the rotary atomizer and then leaves the deflection ring opposite to the spraying direction of the rotary atomizer in order to flow over the drive turbine wheel. Here the deflection ring just effects a deflection by a deflection angle of about 90°. The remaining 90° of the total required deflection angle of 180° can then be realized outside the drive turbine. It is, however, also possible within the scope of the exemplary illustrations, that the deflection ring achieves the total required deflection angle of 180°.

Furthermore, the deflection ring may also have another function in the exemplary illustrations, in such a way that the deflection distributes the drive fluid evenly over the whole annular through-flow cross-section of the axial turbine and, in this way, achieves an even flow.

Furthermore, there is also the possibility that there is a stator integrated into the deflection ring which can, for example, be molded as one piece onto the deflection ring.

Furthermore, the deflection ring can also form a seal or contain a separate gasket in order to seal an annular gap between the deflection ring and the turbine shaft to the bell cup.

The turbine rotor according to the exemplary illustrations may also not only be fitted with a turbine rotor, e.g., as previously described above in detail but also, in another exemplary illustration, a turbine housing and at least one guide air line to supply a guide air ring, wherein the guide air line may be, at least partially, led through the turbine housing.

Furthermore, the drive turbine according to the exemplary illustrations may also has a bearing unit in which the turbine rotor is rotatably mounted on bearings. One particularity of the drive turbine according to the exemplary illustrations may be that there is a paint tube for feeding the coating material to be applied, which projects through the hollow turbine shaft and is fastened to the bearing unit, e.g., by a screw connection. In contrast to the conventional rotary atomizers, the bearing unit can therefore be directly screwed with the paint tube to a unit. This allows, for appropriate tolerances and a centering tool incorporated on the front side for assembly between the paint tube and turbine shaft, for the concentricity and placing flat to be achieved far better so that no relative movement takes place between the bearing unit and the paint tube.

The drive turbine according to the exemplary illustrations also may include an intermediate sleeve, which surrounds a radial bearing, the deflection ring and/or parts of the turbine rotor. The intermediate sleeve may generally consist of a mechanically strong material such as aluminum, steel or an allow, whereas the surrounding housing can be made out of a mechanically less loadable material such as a plastic. Here the intermediate sleeve may also have the task of feeding the deflection ring, which was previously described above in detail, with the drive fluid, wherein also part of the required deflection of the drive fluid can take place within the intermediate sleeve.

Furthermore, the drive turbine according to the exemplary illustrations in may have at least one stator ring with a plurality of guide vanes, wherein the stator ring surrounds the turbine shaft in an annular form and is arranged in a stationary condition.

The drive turbine according to the exemplary illustrations may have a novel bearing flange to connect the drive turbine mechanically and fluidically with a rotary atomizer in which the drive turbine is installed and which is driven in a mounted condition by the drive turbine. The exemplary novel bearing flange may generally differ from the conventional bearing flanges on known drive turbines in that the various connections are distributed over two connection levels, wherein both connection levels are axially spaced apart from one another. The first connection level here may be arranged proximally, that is to say on the robot or on the machine side. In contrast to this the second connection level may be arranged distally, that is on the bell cup side. The first connection level here may contain all feed air connections for air supplies, e.g., for guide air, drive air, bearing air and brake air. On the other hand the second connection level of the bearing flange may contain all exhaust air connections for air return flows.

The first connection level here may, in one example, be essentially formed in the shape of a ring, wherein the feed air connections are arranged in the front face of the ring distributed over the ring. The exhaust air connections in the second connection levels may then be essentially arranged in the middle within the ring of the first connection level.

Furthermore, the second connection level of the bearing flange may have a feather key groove to receive a feather key mounted on the paint tube side for rotation prevention and centering of a paint tube.

The second connection level of the bearing flange can furthermore may have at least one thread set for fastening a paint tube.

Furthermore, there is the possibility that the second connection level of the bearing flange has an essentially planar contact surface on its distal side.

Furthermore, the bearing flange may have at least one feed-through bore hole for feeding through an optical waveguide for detecting the rotational speed of the drive turbine, wherein the feed-through bore hole for the optical waveguide is arranged in the second connection level.

Furthermore, it should also be mentioned that the exhaust air connection for brake air and/or bearing air may be offset radially outwards relative to the other exhaust air connections (for example for the motor drive air and guide air).

Furthermore, it should also be mentioned that the exhaust air connection for the drive air may have a significantly larger cross-section than the other exhaust air connections.

Furthermore, the first connection level of the bearing flange may have an axially aligned fitted pin and/or an axially aligned locating bore hole for such a fitted pin, in order to position the drive turbine.

The exemplary bearing flanges furthermore may also differ from previous types, e.g., also as regards sealing of the connections. Thus axial seals (for example O-rings) may be used in the exemplary bearing flange instead of the conventionally used radially sealing O-rings. This can provide for larger duct cross-sections. One further advantage is that pressed in nipples are necessary for the conventionally used radially sealing O-rings, dispensing of the need for which increases the ease of assembly of the bearing flange, e.g., as described herein in the exemplary illustrations.

Furthermore, it should also be mentioned that an exemplary rotary atomizer may carry a bell cup with a certain diameter in the range of 30-80 millimeters (mm), wherein the outer diameter of the turbine or bell cup shaft may lie in the range of 24-28 mm. Therefore, within the scope of the exemplary illustrations, it is striven for achieving a particularly advantageous ratio between the diameter of the bell cup on the one hand and the shaft diameter on the other hand, wherein this ratio may lie in the range of 1.07-3.33.

Finally it should also be mentioned that the exemplary illustrations also encompass the previously described individual components (for example intermediate sleeve, bearing unit, stator ring, deflection ring, bearing flange etc.), independently of the other technical features and components.

FIG. 1 shows a schematic representation of a drive turbine 1 according to an exemplary illustration for driving a turbine shaft 2 which, during operation, carries a conventional bell cup 3 on its distal end 2.

In contrast to the conventional radial turbines, the drive turbine 1 is formed as an axial turbine. This means that the drive air flows through the axial turbine in an axial direction.

To this effect, the drive turbine 1 has a plurality of rotor rings 4, 5, 6 which can be shrunk onto the outer lateral surface of the turbine shaft 2, which will be described in greater detail with reference to FIG. 2.

Furthermore, the exemplary drive turbine 1 may have a plurality of stator rings 7, 8 which are respectively arranged between two of the neighboring rotor rings 4-6.

Here, the drive air is fed in on the robot side and initially flows in an axial direction outside the drive turbine 1 up to a deflection ring 9 which deflects the drive air through 180° and introduces it into the first rotor ring 4.

It should also be mentioned that the annular shaped through-flow cross-section of the drive turbine 1 increases in the direction of flow (that is in the drawing from left to right). It is furthermore clear that the basic diameter of the blade of the rotor rings 4, 5, 6 is constant, whereas the blade height of the rotor rings 4, 5, 6 differs in order to realize an increasing through-flow cross-section in the direction of flow.

Figure 2:
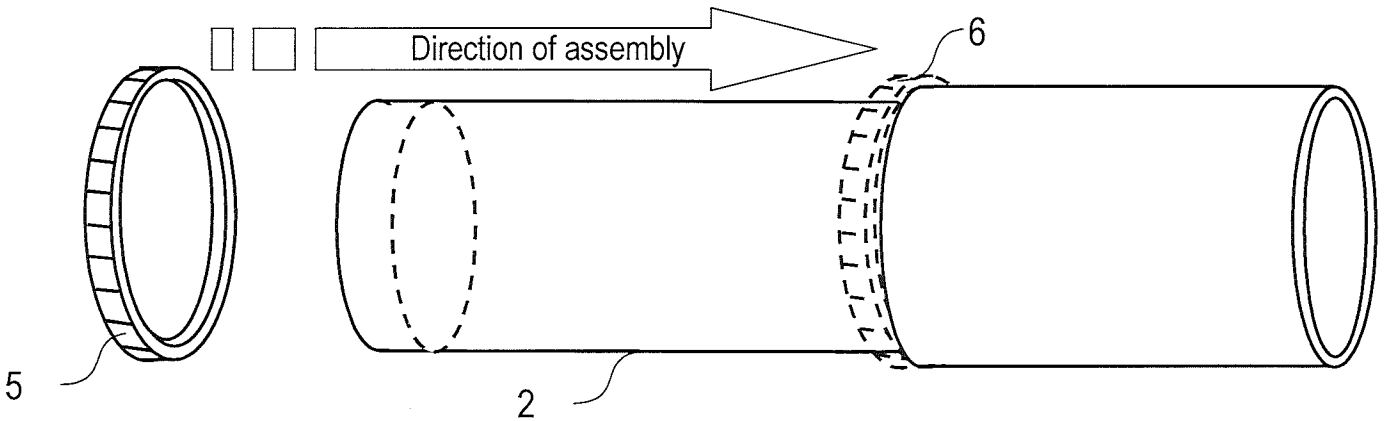

It is clearly visible from the representation which is also schematic in FIG. 2 that the rotor rings 5, 6 can be slipped in an axial direction onto the turbine shaft 2 in order to mount the rotor rings 5, 6 on the turbine shaft 2. The mounted rotor rings 5, 6 can then be fixed to the turbine shaft 2, for example by means of a press fit or through thermal shrink fitting, merely as examples.

An exemplary drive turbine 10 is now described below with reference to FIGS. 3 to 9, wherein the drive turbine 10 has a turbine housing 11, an intermediate sleeve 12 with a radial bearing 13 and a deflection ring 14, a turbine unit 15 with stator and rotor rings, a radial-axial bearing 16, a turbine shaft 17 with a molded on brake turbine wheel 18, a spacer ring 19 and a bearing flange 20.

The structure and function of the turbine housing 11 is now first described below with reference to the perspective representations in FIGS. 4 and 5.

It should initially be mentioned that the turbine housing 11 has a plurality of guide air nozzles on its front side, wherein a jet of guide air can be applied through the guide air nozzles 21 in order to form the spray jet emitted by the bell cup.

The turbine housing 11 in this exemplary illustration comprises a mechanically stable material (such as an aluminum alloy) and is partially surrounded by a cover 11' which is made out of plastic.

There may also be an electrical through-contacting device 22 in the front area of the turbine housing 11 which interacts with an appropriately adapted through-contacting device 23 in the intermediate sleeve 12 (see also FIG. 6) and allows electrical contacting.

The structure and function of the intermediate sleeve 12 is now first described below with reference to the perspective representations in FIGS. 4 and 6.

In the front area the intermediate sleeve 12 carries the radial bearing 13 for mounting the turbine shaft 17 in bearings.

Figure 6:
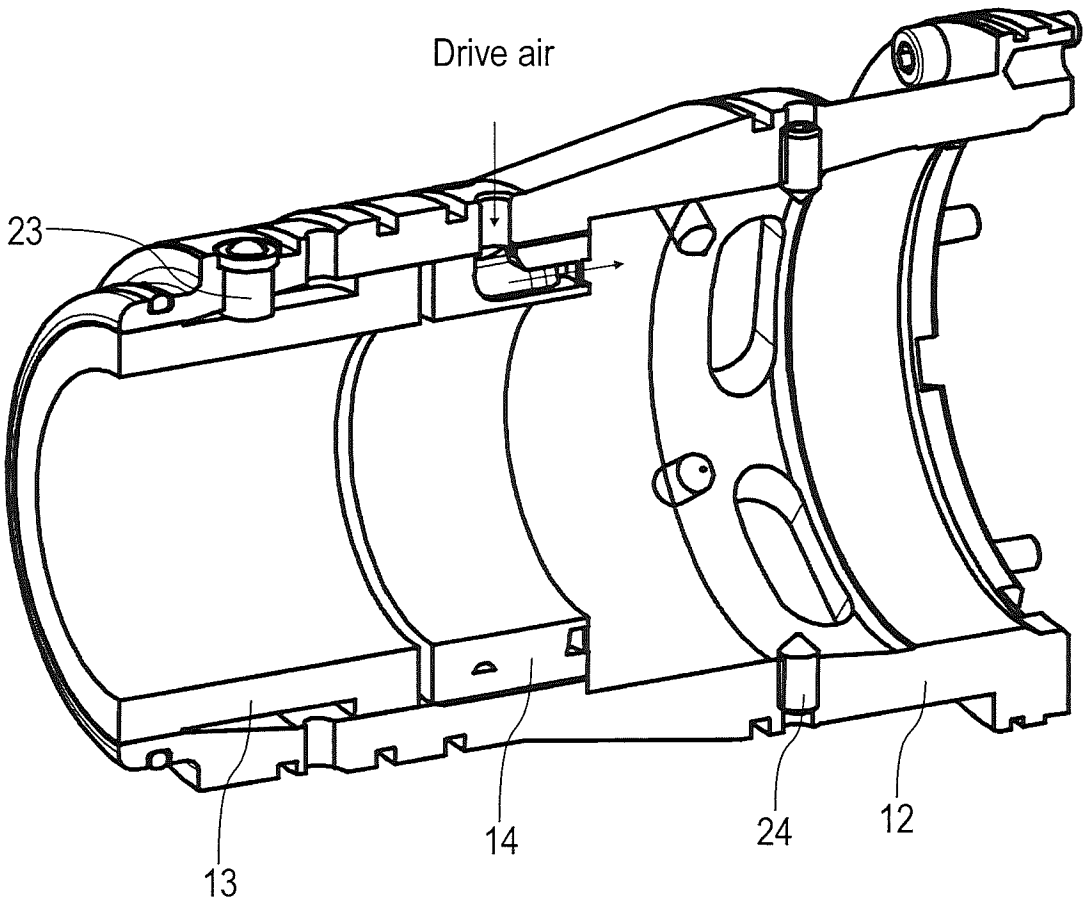

Therebehind, in an axial direction, is the deflection ring 14 which has the task of deflecting the drive air arriving radially at right angles in the deflection ring 14 to the rear so that the drive air enters the turbine unit 15 arranged axially behind the deflection ring 14, wherein the turbine unit 15 is not shown in FIG. 6.

Figure 4:
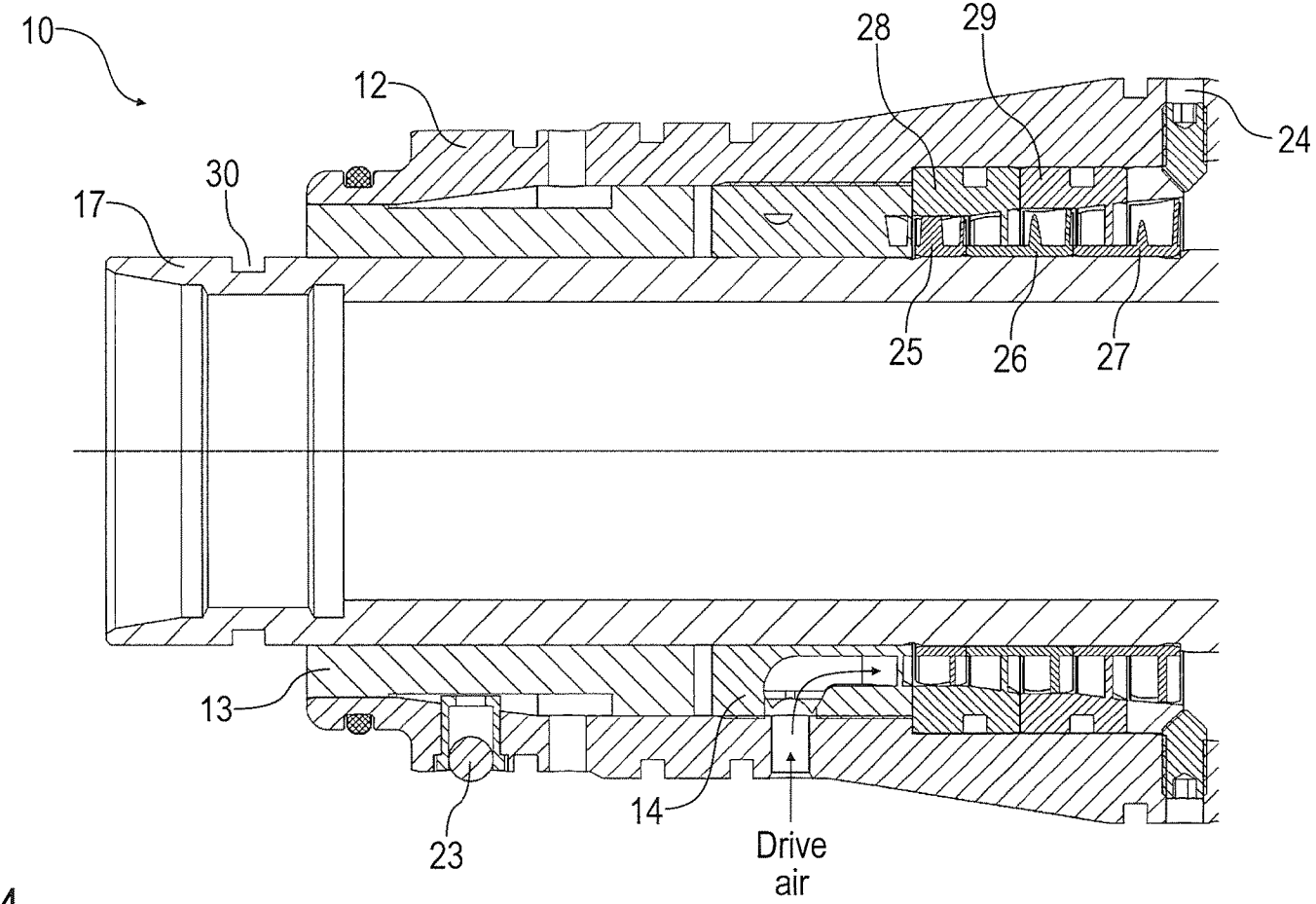
Figure 5:
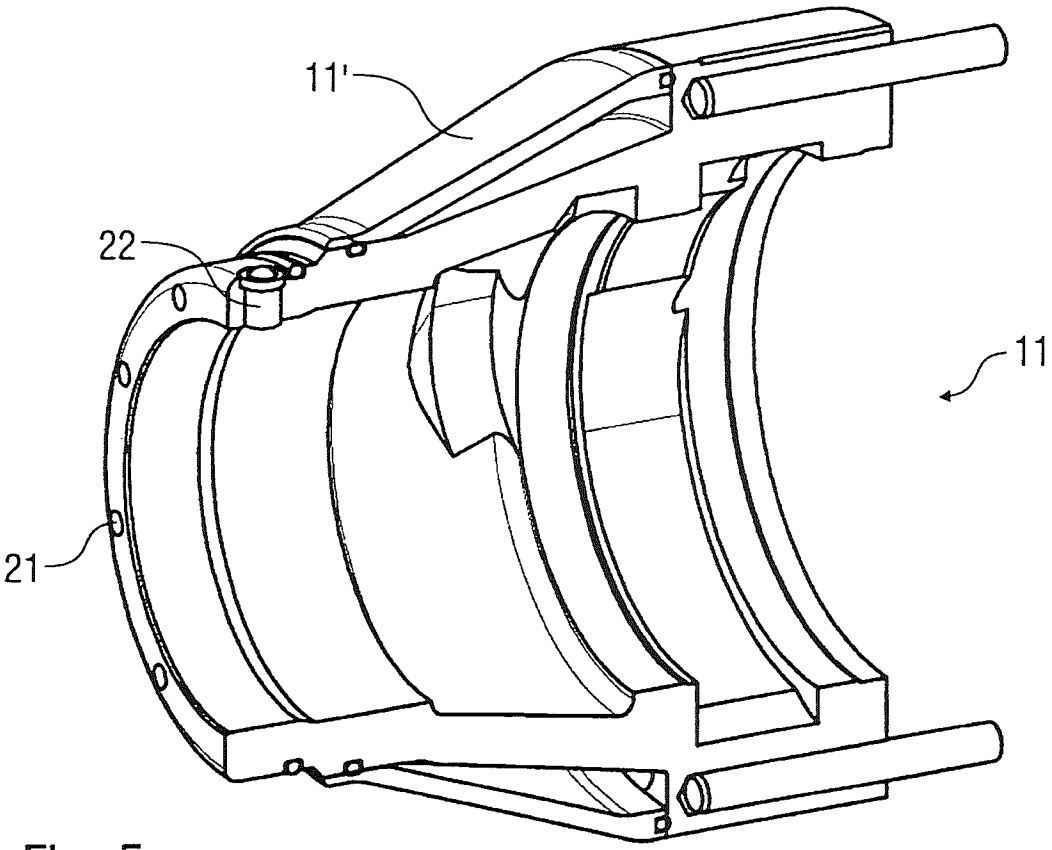

It is, however, quite clear from FIGS. 4 and 6 that the intermediate sleeve 12 has a plurality of radial bores 24 distributed over its circumference into which the appropriately adapted grub screws can be screwed in, in order to fix the turbine unit 15 in place in an axial direction, as is shown in FIG. 4.

The structure and function of the turbine unit 15 is now described below with reference to the perspective representations in FIGS. 4 and 7. Thus the turbine unit 15 in this exemplary illustration comprises a plurality of rotor rings 25, 26, 27, which are arranged on the turbine shaft 17 and are connected in a twist-proof manner with the turbine shaft 17.

The rotor rings 25, 27 may be surrounded by a plurality of stator rings 28, 29, wherein the stator rings 28, 29 are fixedly mounted and do not turn during operation.

Figure 7:
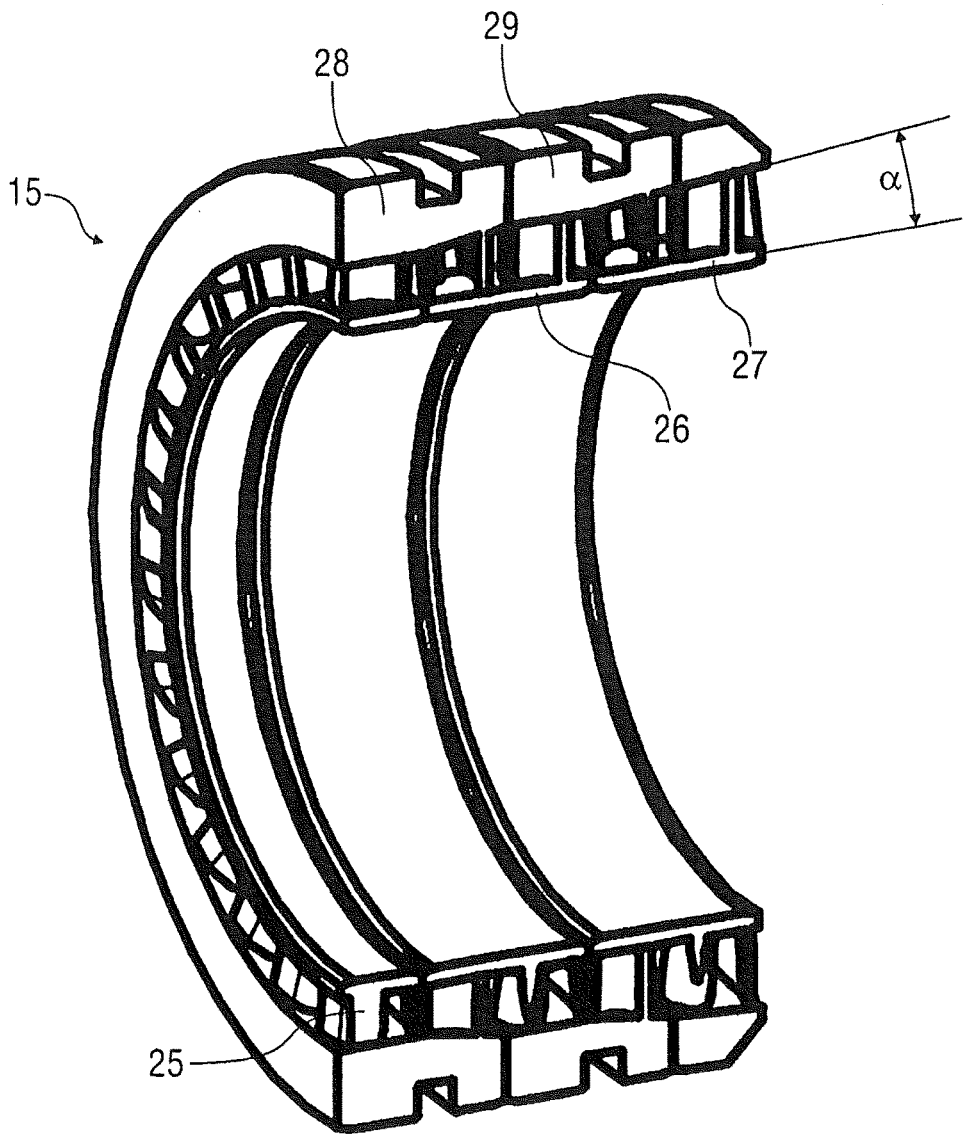
Figure 8:
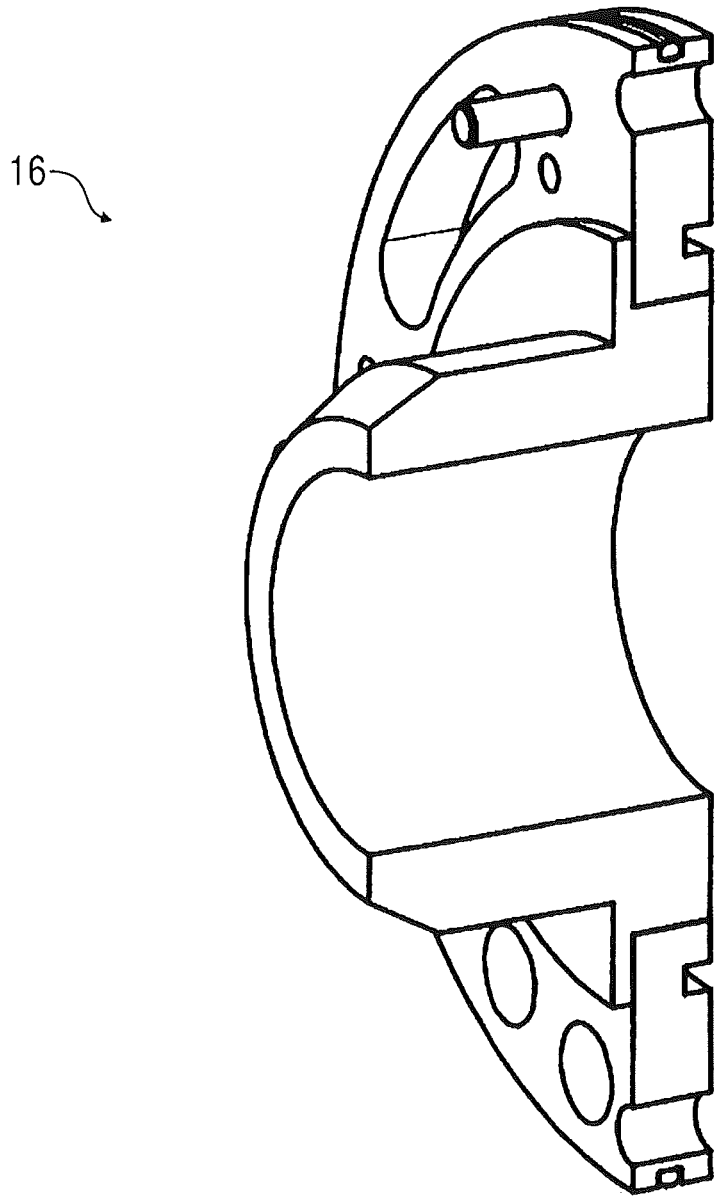

It is furthermore clear from FIG. 7 that the turbine unit 15 may have an annular through-flow cross-section which widens out in the direction of flow with a widening angle $\alpha$, so that the through-flow cross-section of the downstream arranged rotor ring 27 is greater than the through-flow cross-section of the upstream arranged rotor ring 25. This is very meaningful from a fluid dynamics point of view because the drive air expands through flowing through the turbine unit from one stage to the next stage. The widening angle $\alpha$ can, for example, lie in the range of 5°-10° and is determined by fluid dynamics considerations.

Figure 9:
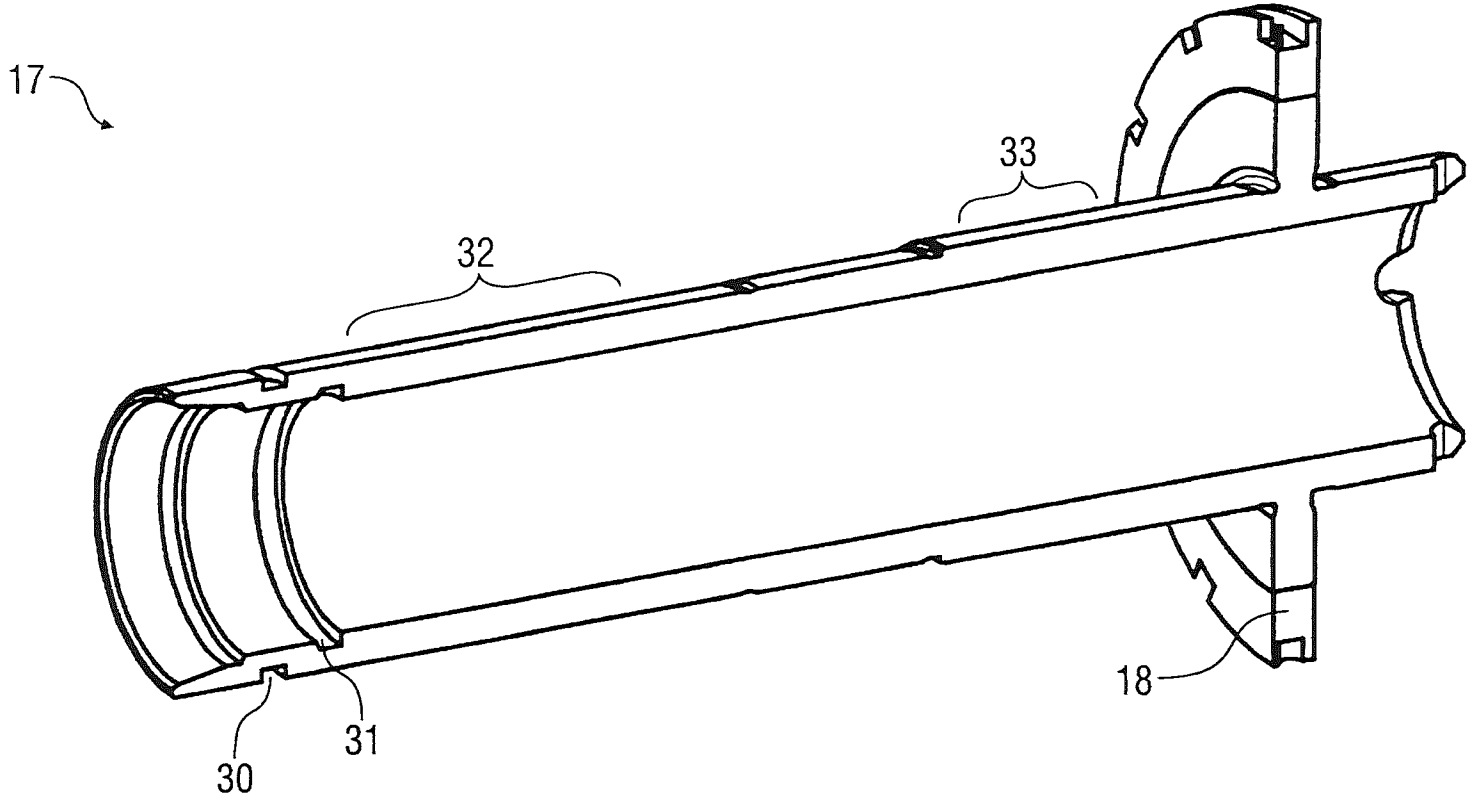

The function and structure of the turbine shaft 17 is now described below with reference to the perspective representations in FIGS. 4 and 9.

The turbine shaft 17 may have on its distal end both inside and also outside respectively an annular groove 30, 31 which serves to assemble a bell cup. As an alternative, however, it is also possible that the turbine shaft 17 has an inner thread on its distal end onto which the bell cup can be screwed.

Furthermore, the turbine shaft 17 has two bearing points 32, 33 on which the turbine shaft is mounted in the radial bearing 13 or in the radial-axial bearing 16.

Finally the turbine shaft 17 may have a molded-on brake turbine wheel 18 in order to be able to brake the turbine shaft 17 with the bell cup mounted on it as quickly as possible. The brake turbine wheel 18 is formed here as a Pelton turbine wheel and therefore has many turbine blades which are formed for a radial flow of drive air.

The brake turbine wheel 18 is arranged in an axial direction outside both bearing points 32, 33. In contrast to this, the turbine unit 15 of the drive turbine 10 may be arranged in a mounted condition axially between both bearing points 32, 33.

Figure 10:
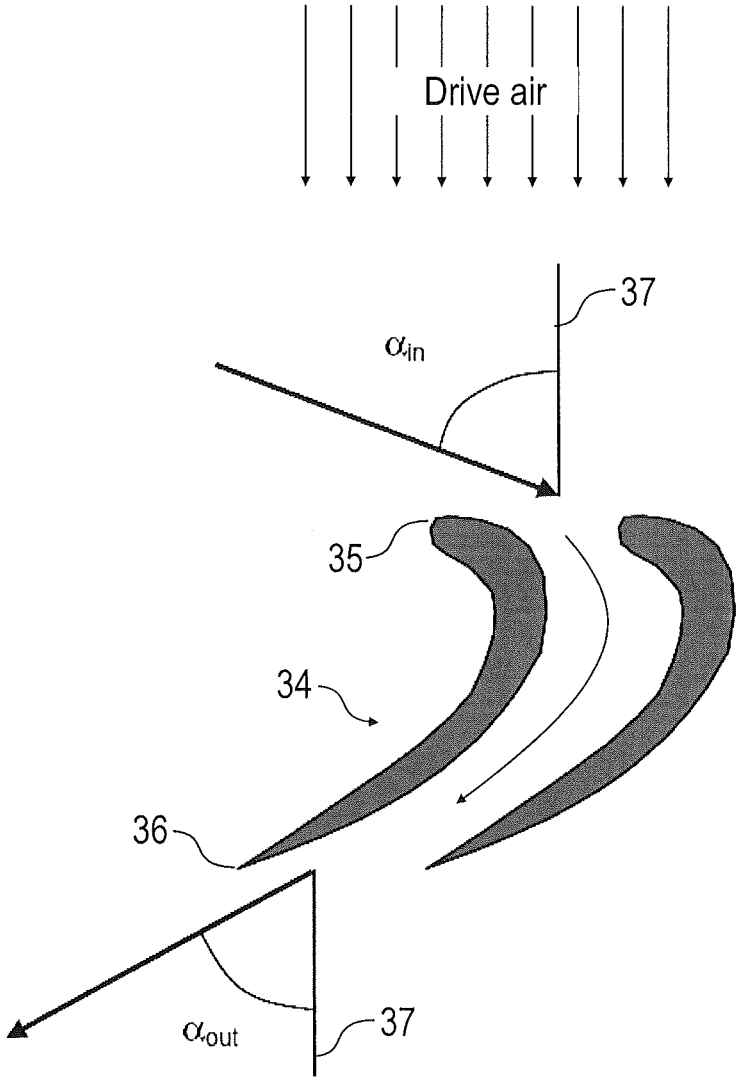

Furthermore, FIG. 10 shows a schematic illustration of an exemplary turbine blade 34 with a leading edge 35 and a trailing edge 36. The leading edge 35 of the turbine blade 34 is angled here relative to a schematically illustrated axial direction 37 by an inlet angle $\alpha_{IN}$ of approximately 70°. Furthermore, the trailing edge 36 of the turbine blade 34 is also angled relative to an outlet angle $\alpha_{OUT}$ relative to the axial direction 37, wherein the inlet angle $\alpha_{IN}$ is approximately equal to the outlet angle $\alpha_{OUT}$.

Figure 11:
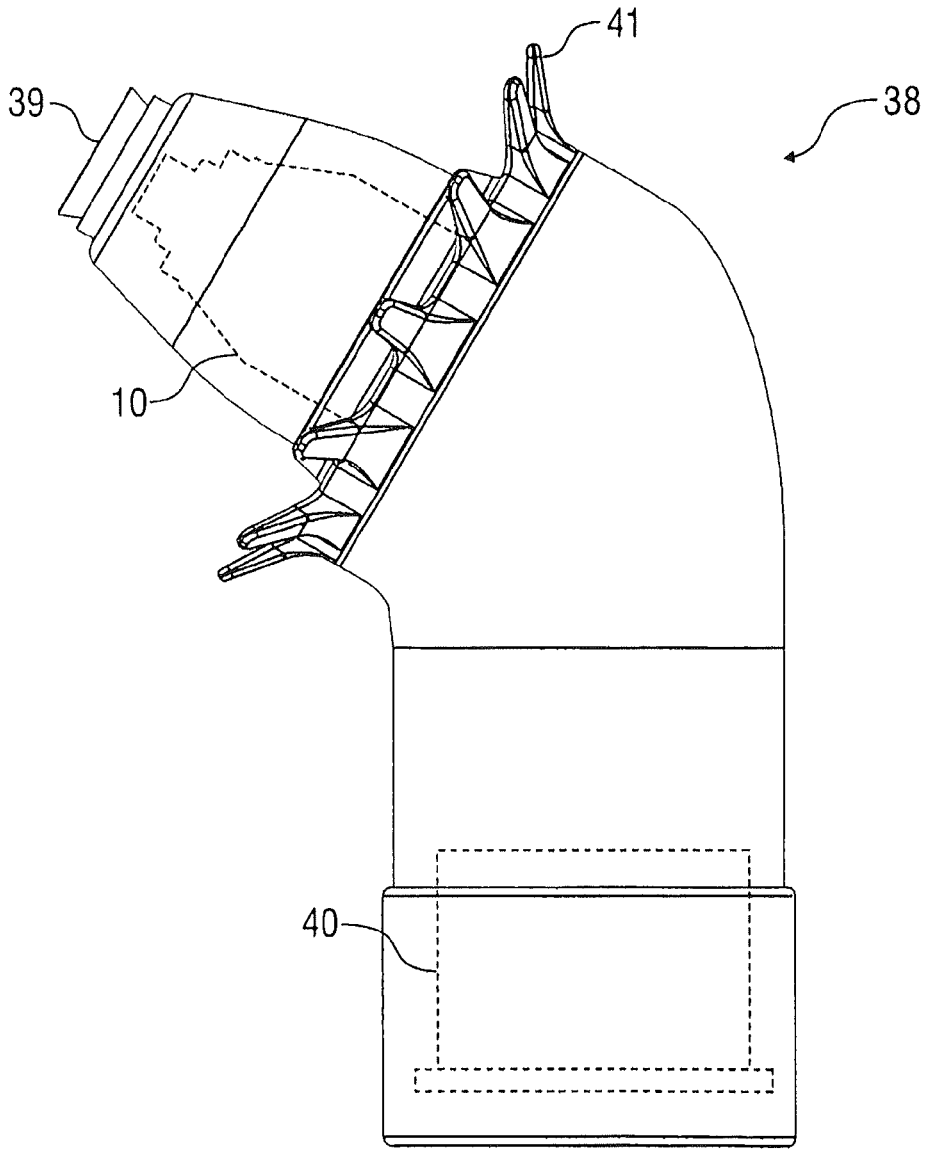

Finally FIG. 11 shows an exemplary rotary atomizer 38 with the schematically represented drive turbine 10, which drives a bell cup 39.

Furthermore, a valve unit 40 is represented schematically in this drawing.

Finally, the drawing shows an electrode ring 41 for external charging of the coating agent sprayed by the bell cup 39.

Figure 12A:
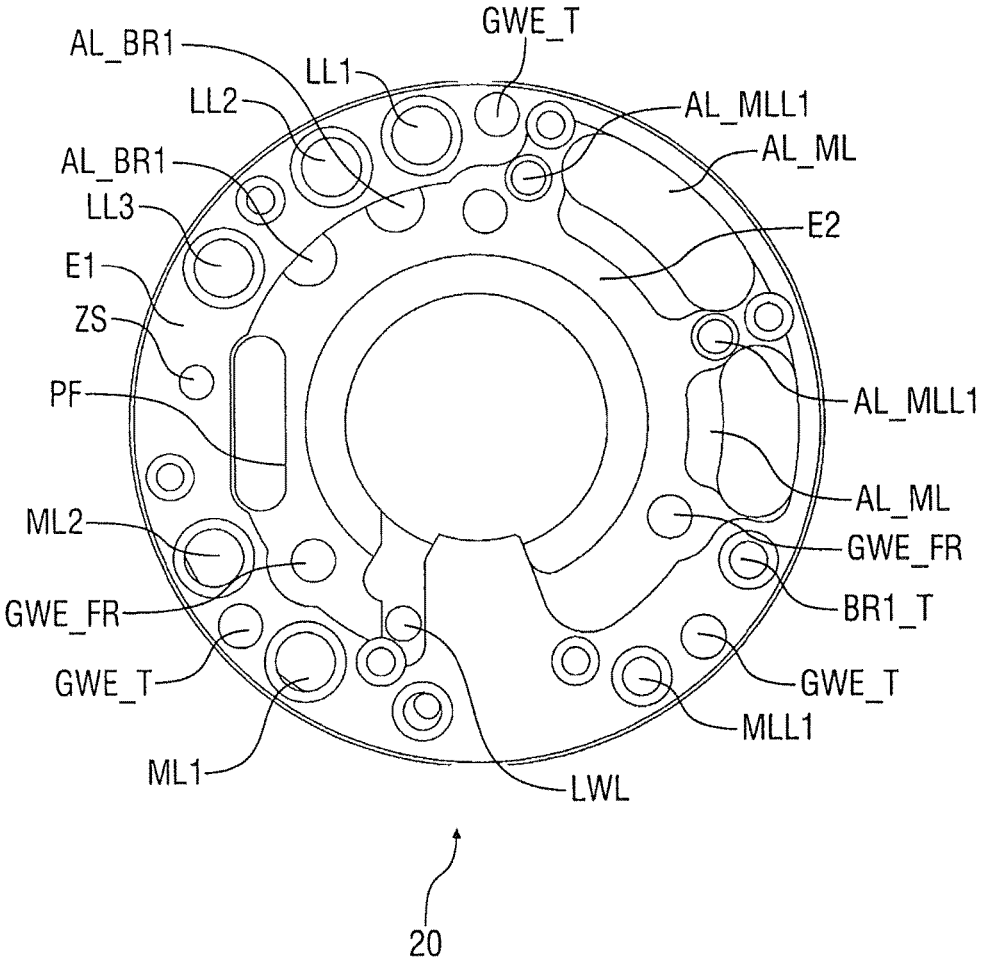
FIG. 12B a slight perspective representation of the bearing flange of the drive turbine.
Figure 12B:
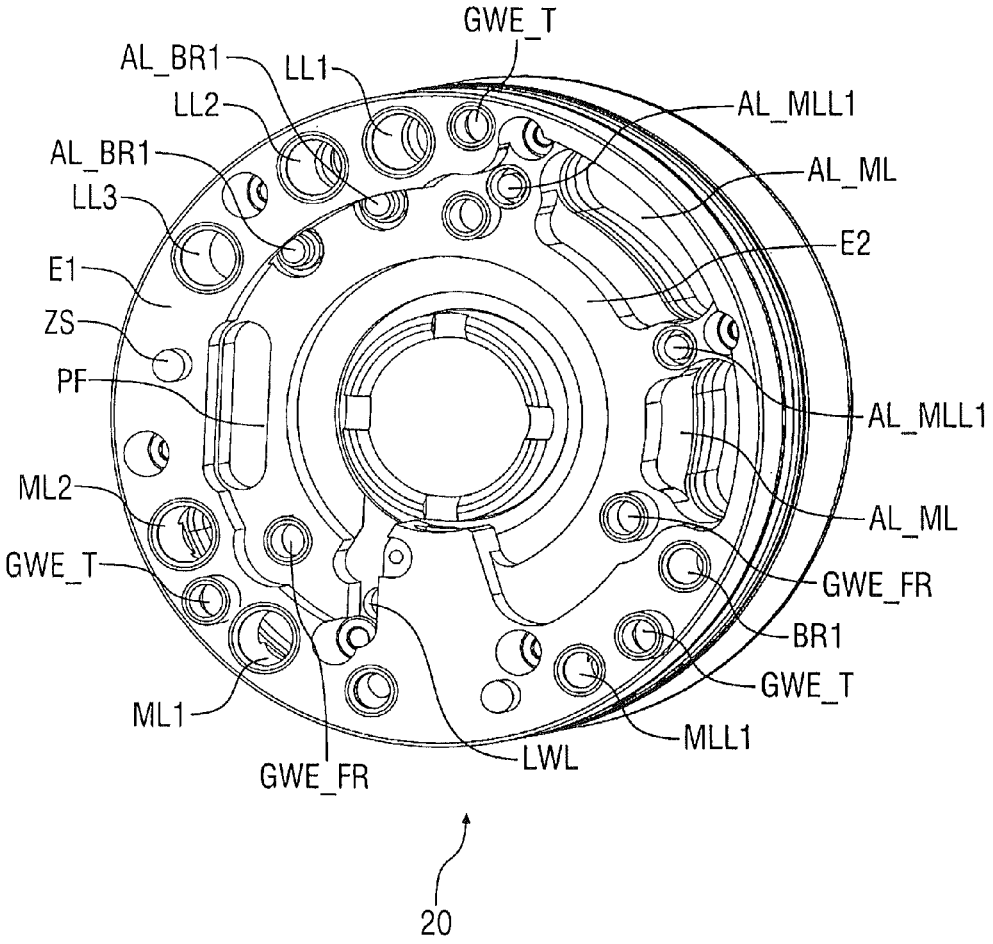

The structure and function of the bearing flange 20 is now described in the following with reference to FIGS. 12A and 12B, which is already been shown in perspective in FIG. 3.

Figure 3:
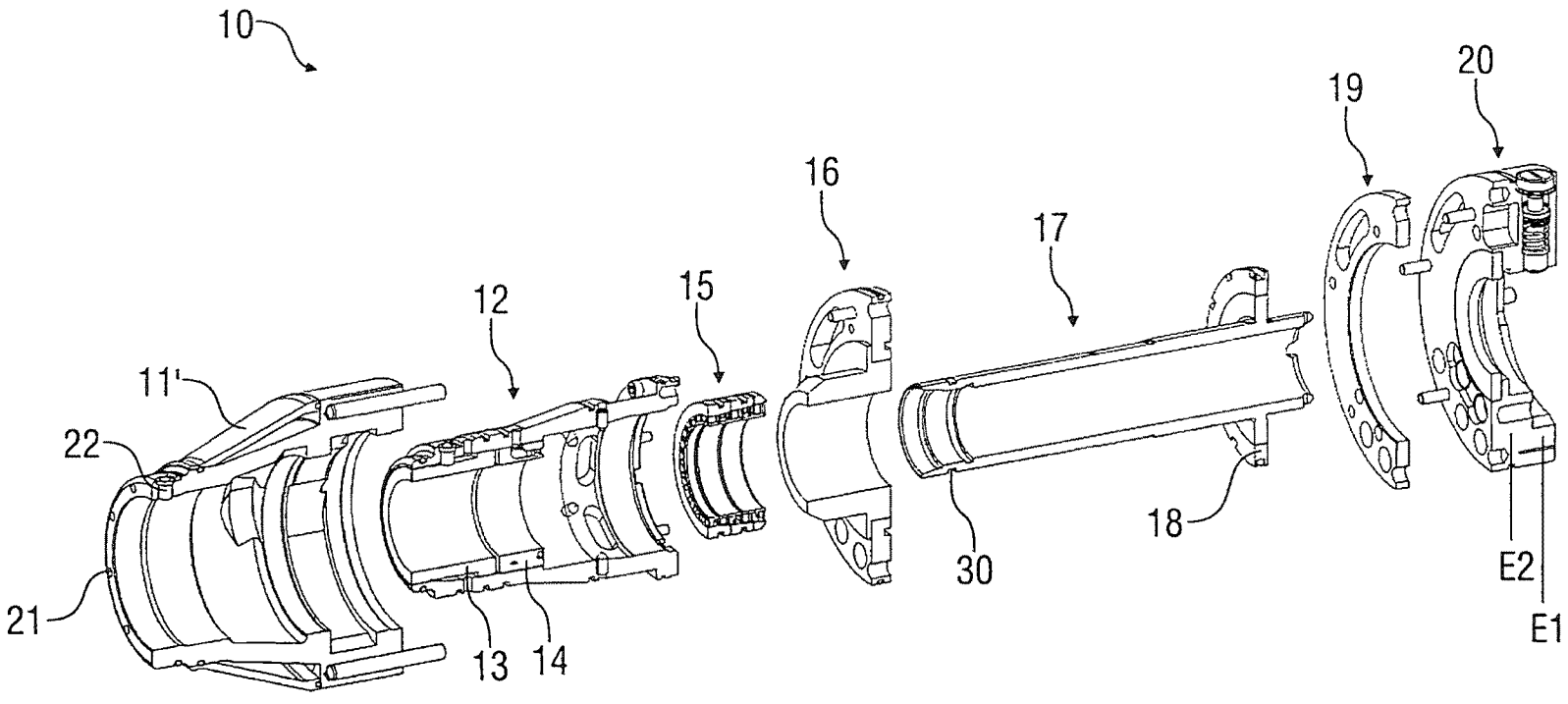

The bearing flange 20 may have two connection levels E1, E2 that are axially spaced apart from one another, as can be seen in FIG. 3.

The first connection level E1 here contains all feed air connections LL1-LL3, ML1-ML2, BR1 and MLL1, namely for guide air, motor air or drive air, motor bearing air and brake air.

The second connection level E2, on the other hand, contains all exhaust air connections AL_MLL1, AL_ML, AL_BR1.

The first connection level E1 may be proximally formed in the shape of a ring, wherein the various feed air connections LL1-LL3, ML1-ML2, BR1 and MLL1 are arranged in the front face of the ring.

In contrast to this, in the distally arranged second connection level E2, the exhaust air connections AL_MLL1, AL_ML, AL_BR1 may be essentially arranged in the middle within the ring of the first connection level E1.

The bearing flange 20 also may include thread inserts GWE_T for the turbine, thread inserts GWE_FR for a paint tube, a bore hole LWL for an optical waveguide for detecting the rotational speed as well as a feather key PF and a centering pin ZS.

It is furthermore significant that the various feed air connections LL1-LL3, ML1-ML2, BR1 and MLL1 and the exhaust air connections AL_MLL1, AL_ML, AL_BR1 are not sealed by radially sealing O-rings, in contrast to conventional bearing flanges, but instead by axially (flat) sealing O-rings. This offers the advantage that larger duct cross-sections can be realized. Furthermore, dispensing of the need for the nipple, which is otherwise usually needed for radial sealing O-rings, increases the assembly comfort.

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain examples, and should in no way be construed so as to limit the claimed invention.

Accordingly, it is to be understood that the above description is intended to be illustrative and not restrictive. Many examples and applications other than those specifically provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

LIST OF REFERENCE SIGNS

1 Drive turbine
2 Turbine shaft
3 Bell cup
4 Rotor ring
5 Rotor ring
6 Rotor ring
7 Stator ring
8 Stator ring
9 Deflection ring
10 Drive turbine
11 Turbine housing
11' Cover
12 Intermediate sleeve
13 Radial bearing
14 Deflection ring
15 Turbine unit
16 Radial-axial bearing
17 Turbine shaft

18 Braking turbine wheel
19 Spacer ring
20 Bearing flange
21 Guide air nozzles
22 Through-contacting
23 Through-contacting
24 Radial bore hole
25 Rotor ring
26 Rotor ring
27 Rotor ring
28 Stator ring
29 Stator ring
30 Annular groove
31 Annular groove
32 Bearing point
33 Bearing point
34 Turbine blade
35 Leading edge of the turbine blade
36 Trailing edge of the turbine blade
37 Axial direction
38 Rotary atomizer
39 Bell cup
40 Valve unit
41 Electrode ring
$\alpha$ Widening angle of the through-flow cross-section
$\alpha_{IN}$ Inlet angle of the turbine blades
$\alpha_{OUT}$ Oulet angle of the turbine blades
LL1 Supply air connection for guide air 1
LL2 Supply air connection for guide air 2
LL3 Supply air connection for guide air 3
ML 1 Supply air connection for motor air 1
ML2 Supply air connection for motor air 2
GWE_T Threaded insert for turbine
GWE_FR Threaded insert for paint tube
E1 First connection plane
E2 Second connection plane
AL_MLL1 Exhaust air connection for motor bearing air 1
AL_ML Exhaust air connection for motor air
AL_BR1 Exhaust air connection for brake air 1
BR1 Supply air connection for brake air 1
MLL1 Supply air connection for motor bearing air 1
LWL Borehole for optical waveguide
PF Feather key
ZS Centering pin

The invention claimed is:

1. A turbine rotor assembly adapted for a drive turbine of a rotary atomizer, comprising:

a housing;

a turbine shaft rotatably supported by the housing and configured to be secured to a bell cup;

first and second drive turbine wheels each coupled to the turbine shaft and each coaxially oriented with the turbine shaft, each of the first and second drive turbine wheels having a plurality of radially-protruding turbine blades, wherein the turbine blades of the first and second drive turbine wheels are configured to translate forces from an axial drive flow to drive rotation of the first and second drive turbine wheels and the turbine rotor;

first and second stator rings each coupled to the housing and respectively radially surrounding the first and second drive turbine wheels;

a deflection ring coupled to the housing and coaxially oriented with the turbine shaft, the deflection ring being axially forward of the first and second drive turbine wheels, wherein the deflection ring and the first and second stator rings define an axially-extending drive flow path overlapping the turbine blades of the first and second drive turbine wheels, respectively.

2. The turbine rotor assembly according to claim 1, wherein the first and second drive turbine wheels are axially arranged one behind the other.

3. The turbine rotor assembly according to claim 1, wherein the first and second drive turbine wheels extend over a first axial drive length and the housing defines a first outer housing diameter, the housing and the first and second drive turbine wheels being configured with a ratio greater than 0.4 and less than 1, and the first and second stator rings define a maximum stator outer diameter, the first and second stator rings and the first and second drive turbine wheels being configured with a ratio greater than 0.4 and less than 0.5.

4. The turbine rotor assembly according to claim 1, wherein the turbine blades of the first and second drive turbine wheels have different blade heights, respectively.

5. The turbine rotor assembly according to claim 1, wherein:

each of the first and second drive turbine wheels has a density of turbine blades greater than 15 turbine blades per drive turbine wheel and less than 80 turbine blades per drive turbine wheel, and the first and second drive turbine wheels have different densities of turbine blades.

6. The turbine rotor assembly according to claim 5, wherein the first and second drive turbine wheels are arranged so that the density of turbine blades of the first and second drive turbine wheels, respectively, increases in the direction of the axial drive flow.

7. The turbine rotor assembly according to claim 5, wherein the first and second drive turbine wheels are arranged so that the density of turbine blades of the first and second drive turbine wheels, respectively, increases against the direction of the axial drive flow.

8. The turbine rotor assembly according to claim 1, wherein at least one of the first and second drive turbine wheels is removably coupled to turbine shaft.

9. The turbine rotor assembly according to claim 1, wherein at least one of the first and second drive turbine wheels and the turbine shaft are formed in one piece.

10. The turbine rotor assembly according to claim 1, wherein the turbine shaft has a pair of bearing points for rotatable mounting of the turbine shaft, and the first and second drive turbine wheels are arranged axially between the pair of bearing points.

11. The turbine rotor assembly according to claim 10, further including:

a brake turbine wheel with a plurality of turbine blades coupled to the turbine shaft and coaxially oriented with the turbine shaft, the brake turbine wheel being configured to operate with a radial flow of the brake fluid.

12. The turbine rotor assembly according to claim 11, wherein the brake turbine wheel is arranged axially outside of the pair of bearing points.

13. The turbine rotor assembly according to claim 11, wherein the brake turbine wheel has a larger diameter than the first and second drive turbine wheels.

14. The turbine rotor assembly according to claim 11, wherein the turbine blades of each of the first and second drive turbine wheels and the brake turbine wheel each have a front edge which is aligned with an inlet angle defined relative to the axis of rotation of the turbine rotor, and the turbine blades of each of the first and second drive turbine wheels and the brake turbine wheel each have a rear edge which is aligned with an outlet angle defined relative to the axis of rotation of the turbine rotor, and the sum of the inlet angle and the outlet angle are configured with a sum greater than 90° and less than 160°, with the outlet angle being greater than 55° and smaller than 85°.

15. The turbine rotor assembly according to claim 1, wherein the turbine rotor is configured to have a certain specific rotational speed $n_s$ during operation, the specific rotation speed $n_s$ defined using the following formula:

$$n_S = \frac{\omega \cdot V^{0.5}}{e^{0.75}}$$

with:

V: volumetric flow rate at the entrance [$m^3/s$]

e: specific work [J/kg]

ω: rotational speed [rad/s], and wherein the specific rotational speed $n_s$ is less than 0.4 and greater than 0.07.

16. The turbine rotor assembly according to claim 10, wherein each of the pair of bearing points of the turbine shaft define an axial bearing length, the turbine shaft has a shaft diameter, and the bearing length of each of the pair of bearing points and the shaft diameter being configured with a ratio greater than 0.6 and less than 1.4.

17. The turbine rotor assembly according to claim 1, wherein the turbine shaft is hollow and has a shaft internal diameter configured to to receive a paint tube with two main needles and two returns.

18. The turbine rotor assembly according to claim 1, wherein the turbine shaft is hollow and has a shaft internal diameter configured to receive two mixing elements for a two-component material.

19. The turbine rotor assembly according to claim 1, wherein the turbine shaft is hollow and has a shaft internal diameter of more than 18 mm and less than 22 mm.

20. The turbine rotor assembly according to claim 1, wherein the turbine blades of the first and second drive turbine wheels each have a radial blade height greater than 0.5 mm and less than 60 mm.

21. The turbine rotor assembly according to claim 1, wherein the turbine blades of the first and second drive turbine wheels have a radial blade height, the turbine shaft defines a shaft diameter, and the turbine blades and the turbine shaft being configured with a ratio of the blade height and the shaft diameter being greater than 0.01 and less than 3.

22. The turbine rotor assembly according to claim 1, wherein the first drive turbine wheel is axially between the deflection ring and the second drive turbine wheel.

23. The turbine rotor assembly of claim 22, wherein the turbine blades of the first drive turbine wheel have a first height, the turbine blades of the second drive turbine wheel have a second height, and the second height is greater than the first height.

24. The turbine rotor assembly of claim 22, wherein the drive flow path radially increases from the first drive turbine wheel to the second drive turbine wheel.

25. The turbine rotor assembly of claim 1, wherein the drive flow path radially increases along an axially rearward direction.

26. A drive turbine adapted for a rotary atomizer, comprising:

a housing;

a turbine rotor including a hollow turbine shaft rotatably supported by the housing and configured to be secured to a bell cup, and first and second drive turbine wheels each coupled to the turbine shaft and each coaxially oriented with the turbine shaft, each of the first and second drive turbine wheels having a plurality of radially-protruding turbine blades, wherein the turbine blades of the first and second drive turbine wheels are configured to translate forces from an axial drive flow to drive rotation of the first and second drive turbine wheels and the turbine rotor;

first and second stator rings each coupled to the housing and respectively radially surrounding the first and second drive turbine wheels;

a deflection ring coupled to the housing and coaxially oriented with the turbine shaft, the deflection ring being axially forward of the first and second drive turbine wheels;

a bearing flange coupled to the housing and configured to interface with and fluidly couple a rotary atomizer, the bearing flange including feed air connections axially extending therethrough, wherein the deflection ring and the first and second stator rings define an axially-extending drive flow path overlapping the turbine blades of the first and second drive turbine wheels, respectively, and radially increasing along an axial direction.

27. The drive turbine according to claim 26, wherein the drive turbine is configured such that the drive fluid enters the deflection ring in a transverse direction and orthogonally with respect to a spraying direction of the rotary atomizer, and exits against the spraying direction of the rotary atomizer out of the deflection ring in order to flow over the drive turbine wheel, and the first and second drive turbine wheels each have an annular through flow cross-section, respectively, and each annular through flow cross-section is configured such that the drive fluid is distributed substantially evenly over the annular through flow cross-section.

28. The drive turbine according to claim 26, wherein the deflection ring is configured to create a seal with an annular gap between the deflection ring and the turbine shaft.

29. The drive turbine according to claim 26, further comprising:

a guide air line configured to supply a guide air ring with guide air to shape the spray jet discharged by the rotary atomizer, wherein the guide air line is, at least partially, passed through the turbine housing.

30. The drive turbine according to claim 26, further comprising:

a bearing unit for rotatable mounting of the turbine rotor;

a paint tube for feeding the coating material to be applied, wherein the paint tube projects through the turbine shaft and threadingly engages the bearing unit; and an adjustable centering device for centering the paint tube in the turbine shaft.

31. The drive turbine according to claim 26, further comprising an intermediate sleeve configured to receive one of a radial bearing, the deflection ring and a part of the turbine rotor.

32. The drive turbine according to claim 31, wherein the turbine housing is formed of plastic and the intermediate sleeve is made out of metal;

wherein the intermediate sleeve is configured to feed the deflection ring with the drive fluid, and wherein the intermediate sleeve is configured to deflect the drive fluid, wherein the drive fluid enters the intermediate sleeve in the spraying direction and exits in a transverse direction, namely at right angles to the spraying direction inwards out of the intermediate sleeve and passes over into the deflection ring.

33. The drive turbine according to claim 26, wherein the feed air connections of the bearing flange include in air inlets for each of guide air, drive air, bearing air and brake air, the bearing flange contains axially-extending exhaust air connections for air return flows, the feed air connections are arranged in a ring shape, and the exhaust air connections are arranged within the ring shape of the feed air connections.

34. A rotary atomizer, comprising the drive turbine according to claim 26.

* * * * *